United States Patent [19]

Woodward et al.

[11] Patent Number: 4,517,285

[45] Date of Patent: May 14, 1985

[54] PAPERMAKING OF POLYOLEFIN COATED SUPPORTS BY CONTROLLING STREAMING POTENTIAL

[75] Inventors: Antony I. Woodward, Chesham; David G. Clarke, Marlow, both of England; Sunil Shahaney, Madras, India

[73] Assignee: The Wiggins Teape Group Limited, Buckinghamshire, England

[21] Appl. No.: 543,477

[22] Filed: Oct. 19, 1983

[30] Foreign Application Priority Data

Oct. 20, 1982 [GB] United Kingdom ..... 8229986
Aug. 18, 1983 [GB] United Kingdom ..... 8322323

[51] Int. Cl.[3] ..... G03C 1/78; D21H 3/78

[52] U.S. Cl. ..... 430/538; 162/158; 162/135; 162/169; 162/183

[58] Field of Search ..... 430/538; 162/135, 158, 162/169, 183

[56] References Cited

U.S. PATENT DOCUMENTS

| | | | |
|---|---|---|---|
| 4,196,001 | 4/1980 | Joseph et al. | 430/538 |
| 4,305,782 | 12/1981 | Ostreicher et al. | 162/181.6 |
| 4,327,174 | 4/1982 | von Meer | 430/538 |
| 4,331,508 | 5/1982 | Miyama et al. | 430/538 |
| 4,353,981 | 10/1982 | Noda et al. | 430/538 |
| 4,384,040 | 5/1983 | Meer | 430/538 |
| 4,407,896 | 10/1983 | Kubbota et al. | 430/538 |
| 4,410,619 | 10/1983 | Kubbota et al. | 430/538 |

*Primary Examiner*—Jack P. Brammer

*Attorney, Agent, or Firm*—Burns, Doane, Swecker & Mathis

[57] ABSTRACT

Resin coated papers having improved properties especially edge penetration are made using an alkyl ketene dimer neutral size, a wet strength resin and an anionic polyelectrolyte to control the streaming potential of the papermaking stock during manufacture of the paper. Advantageously a supplementary size especially an epoxidized fatty acid amide is also used.

13 Claims, No Drawings

PAPERMAKING OF POLYOLEFIN COATED SUPPORTS BY CONTROLLING STREAMING POTENTIAL

This invention relates to improved techniques for resin coated paper and in particular to making resin coated paper for use as the base for photographic prints.

Resin coated papers are used in the photographic industry as base paper for photographic prints. Developing and fixing the photographic image involves immersion of the base paper in relatively aggressive aqueous solutions which are capable of penetrating the coated paper at the exposed edges. Such edge penetration causes discolouration of the paper which is aesthetically undesirable. This invention is not concerned with paper which is made water resistant solely by incorporation within the paper of materials which render it hydrophobic; it is directed to paper which has a superficial adherent coating on at least one side and usually on both sides of a continuous film of water impermeable polymeric resin.

Resin coated papers are commonly made by the so-called "alkaline" paper making process. The most effective commonly used internal sizing agents in this process are alkyl ketene dimers. Although it is resin coated, it is nevertheless desirable that the base for resin coated paper should have substantial wet strength and, thus, it normally includes an additive, usually referred to as a wet strength resin, to enhance the wet strength of the paper.

We have found that a difficulty arises with the use of alkyl ketene dimer internal sizes and wet strength resins, which are usually cationic, simultaneously present in the papermaking stock. In the absence of other electrically charged species, at zero or very low concentration of cationic wet strength resin the retention of alkyl ketene dimers is fairly low and the sizing of the paper relatively poor; with increasing concentration the sizing improves, we believe because retention of the size is enhanced, reaches a maximum level and, at higher cationic wet strength resin levels, falls away. The wet strength of the paper is directly related to the amount of resin used, although at relatively higher levels the cost effectiveness of further addition falls off. The amount of resin to achieve optimum wet strength is generally significantly higher than the level corresponding to maximum sizing. As the desirable properties of the base paper result, inter alia, from a combination of sizing and wet strength, it has heretofore been necessary to (a) compromise between these two properties, (b) to use a costly excess of size, or (c) to use other active additives to achieve the desired result.

The present invention is based on the surprising discovery that sizing effectiveness of alkyl ketene dimers can be maintained at or near optimum whilst maintaining a desirably high level of wet strength resin by inclusion in the stock of an appropriate amount of an anionic polyelectrolytic species which is adsorbable on the cellulosic material in the paper stock.

Accordingly the present invention provides a method of making a resin coated paper which comprises making a base paper by an alkaline paper making method from a cellulosic fibrous stock containing from 0.2 to 2% by weight on the fibre content of the stock of an alkyl ketene dimer size, from 0.3 to 4% by weight on the fibre content of the stock of a cationic wet strength resin and an amount, within the range 0.02 to 5% by weight on the fibre content of the stock, of an anionic polyelectrolyte which is adsorbable on the cellulosic fibres, which is such as to maintain the streaming potential of the stock within a predetermined range, forming a paper from the stock and providing a coating of a polymeric resin on at least one side, and more usually on both sides, of the paper.

We do not know why the invention works, but we believe that making the base paper from a stock having a streaming potential within a suitable range makes it possible to optimise sizing of the paper, whilst using levels of cationic wet strength resin which would otherwise alter the streaming potential to detract from optimum sizing. The relative improvement in sizing may be the result of enhanced retention and/or higher reactivity of the size towards the fibres.

The streaming potential voltage of a fibrous stock is the measured voltage between electrodes positioned in a stream of the continuous phase respectively upstream and downstream of a mat of the fibres through which the continuous phase is flowing. This measured voltage is a function of the pressure drop across the mat of fibres and as used herein the term "streaming potential" refers to the potential as a voltage per unit pressure drop. The streaming potential is a measure of the electrokinetic properties of the fibrous stock and has been related to the so-called zeta-potential by the Helmholtz-Smoluchowski equation:

$$V=(z.D.P)/(C.v)$$

where:

V = measured streaming potential voltage (i.e. streaming potential = V/P)

z = zeta-potential

D = dielectric constant of liquid continuous phase

P = pressure drop across fibrous mat

C = conductivity of liquid continuous phase v = viscosity of liquid continuous phase.

This equation does not have a rigorous theoretical basis but does illustrate the dependence of the measured voltage on conductivity and, in practice less importantly, dielectric constant and viscosity of the liquid continuous phase of the stock (noting that all three properties are temperature dependent). The sign of the numerical value of the streaming potential is conventionally that of the surface charge on the fibres of the stock. Thus, arbitrarily assigning zero volts to the upstream electrode, the downstream electrode will sense a change of opposite sign to that of the streaming potential.

The streaming potential of an "alkaline" papermaking stock including an alkyl ketene dimer internal size, gives a measure of the expected sizing effect in paper made from that stock. If a means of rapidly measuring streaming potential is available, then monitoring the streaming potential can permit control of the composition of the stock to ensure the desired result in terms of the properties of the product. We believe the reason for the functional relation between streaming potential and sizing effect is that, at low cationic wet strength resin levels the streaming potential is less positive than, and at high resin levels it is more positive than that corresponding to optimum sizing. The anionic adsorbable polyelectrolyte acts to make the streaming potential of the stock less positive i.e. it alters the streaming potential in the opposite direction to the cationic wet strength resin. Thus, inclusion of the anionic polyelectrolyte at a suitable concentration permits the sizing effect of the alkyl ketene dimer and the amount of wet strength resin to be optimised independently. Our European Patent Specification No. 0 079 726 A relates to and describes, apparatus and method for measuring streaming potential which is capable of rapidly and frequently providing values of streaming potential and is thus particularly suited for use in measuring and maintaining streaming potential in the method of the present invention.

By the use of starting materials of consistent composition and quality, it is possible to make a papermaking stock for delivery onto the wire, having a relatively stable measured streaming potential. Thus, once the papermaking process has reached equilibrium the streaming potential may not change very much (allowing for random fluctuations). However, the availability of suitable measuring apparatus makes it possible to actively monitor streaming potential and if necessary to use the measured values to control the papermaking process e.g. by varying the amounts of the additives, especially in this invention the anionic polyelectrolyte.

It will be appreciated that the particular numerical values of streaming potential relevant to the desired result according to this invention, will depend upon the nature of the stock used and in particular the conductivity of the process water. We believe that those skilled in the art will not experience difficulty in determining suitable numerical limit values for the appropriate range of streaming potential in any particular case.

The principal internal size used in this invention is one or more alkyl ketene dimers. These materials can be represented by the formula:

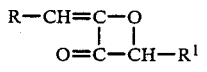

where: R and $R^1$ are each long chain alkyl groups typically $C_{10}$ to $C_{20}$ alkyl groups.

Such materials are readily commercially available as sizes, from several sources. They are normally added to the stock in the form of aqueous emulsions typically containing from 5 to 10% by weight alkyl ketene dimer. We have successfully used the commercially available alkyl ketene dimer emulsion sold under the trademark Aquapel 360 by Hercules Ltd. and that sold by W. R. Grace & Co. under the coding GR940. The amount of alkyl ketene dimer size is from 0.2 to 2% by weight on the fibre. Within this range best results are usually obtained with amounts of from 0.4 to 1.2 and in particular 0.6 to 0.8%. The use of lower levels of size leads to inadequate sizing and the use of higher levels of size is costly and does not give better sizing.

The alkyl ketene dimer internal size can be used alone or in combination with one or more other compatible sizing agents. By the term "compatible sizing agents" we mean sizes which do not alter the basic nature of the sizing system e.g. they do not substantially alter the pH, and which do not interfere with the sizing by the alkyl ketene dimer. In particular we include the use of the sizing agents referred to as epoxy fatty acid amides. Typically these materials are made by reacting a long chain fatty acid e.g. a $C_8$ to $C_{30}$ monocarboxylic fatty acid such as stearic and palmitic acids, with a polyalkylenamine containing at least three amino groups e.g. linear polyalkylenamines such as diethylene triamine, triethylene tetramine and similar materials, to give an amide including at least one, usually secondary, free amino group. This amino amide is then reacted with an amine-reactive compound including an epoxy group e.g. an epihalohydrin especially epichlorohydrin, to give a compound having at least one amino group carrying one or more substituents including an epoxy group, typically a 2-epoxypropyl group.

Such materials are typically cationic to an extent probably determined by the number of amino groups in the amide and the degree of substitution of those amino groups by the epoxy-containing substituents. However, they are much less cationic than the typical wet strength resins, see below, and although they are cationic and, thus, have a relatively adverse effect on streaming potential, this effect is usually not large. When such supplementary sizing agents are used in the stock they will typically be used in an amount of from 0.1 to 2.0%, more usually from 0.2 to 0.8%, by weight on the fibre content of the stock. We have found it advantageous to use about half as much epoxidized fatty acid amide as alkyl ketone dimer as a combination for the internal size. Proportions of from 3:1 to 1:1 of alkyl ketene dimer to epoxidized fatty acid amide would be typical. Generally the high cost of using an unnecessary excess of such a combination size will keep the total amount below 2% and usually below 1.5% by weight on the fibre content of the stock.

Suitable epoxidized fatty acid amide materials are made by Kindai Kagaku KK, under the trade name Neomodulon, by Hercules Ltd. under the designation C55 and by Bayer A. G. under their Baysynthol trademark.

The cationic wet strength resin can be any of those commercially available. However, if the resin coated paper product is intended for use with a photosensitive layer thereon then resins containing free formaldehyde or liable to release formaldehyde during processing or storage will not be used because the formaldehyde would react with the gelatine used in the photosensitive emulsion causing excessive hardening. Suitable formaldehyde-free cationic wet strength resins are polymers made from aminoamide epichlorohydrin condensation products. These can be made by reacting a linear aminopolyamide, itself made by reacting a dicarboxylic acid e.g. adipic acid, with a linear polyamine e.g. triethylene diamine, which has functional secondary amino groups, with epichlorohydrin to give a polymer having tertiary amino groups with pendant 3-chloro-2-hydroxypropyl groups. Further reaction between the tertiary amino groups and the terminal 3-carbon atom by nucleophilic displacement of the 3-chlorine atom in the propyl groups leads to typically two thirds to three quarters of the tertiary amino groups being quaternized. Quaternization leads either to cross-linking of the chains or the formation of azetidinium ring groups. Such compounds are effective wet strength resins having a high degree of cationicity and are readily available commercially. We have successfully used the resin sold under the trade mark Kymene 557H by Hercules Ltd. and that sold by W. R. Grace & Co., under the coding GR932. The amount of cationic wet strength resin used is from 0.3 to 4% by weight on the fibre more usually 0.5 to 2.5% by weight. Amounts of from 1 to 2% are typical. Within these ranges the lower levels correspond to lower levels of size and higher levels to higher levels of size. Overall optimum results are normally obtained when the amounts of both size and wet strength resin are within the optimum ranges stated. As is noted above the amount of cationic wet strength resin used is usually such as to make the streaming potential of the stock more positive than the range corresponding to optimum sizing.

The particular nature of the adsorbable anionic polyelectrolyte is not critical to the invention. Of course, materials having a deleterious effect on the paper e.g. materials including free formaldehyde as noted above, will not be used. Generally the anionic polyelectrolytes are polymeric materials having acidic e.g. carboxylic, pendant groups. Suitable examples include polymers and copolymers containing acrylic acid residues and polymers modified to provide acidic pendant groups. We have successfully used carbomethoxycellulose (as its sodium salt), a copolymer of acrylic acid units available from Allied Colloids under the designation R1144, and a homo/co-polymer of acrylic acid having a molecular weight of about $2.3\times10^4$ daltons available from Allied Colloids under the trade name Versicol E11. The amount of the anionic polyelectrolyte used depends on the change in streaming potential of the stock that is necessary and on the charge density of the polyelectrolyte. However, the use of less than 0.05%indicates that the streaming potential is not significantly different from the predetermined range and suggests that the amount of cationic wet strength resin is lower than desirable for good end product properties. The use of more than 5% indicates either that the anionic polyelectrolyte has a charge density too low to be of practical benefit or that the stock has been rendered undesirably highly cationic. In our trials we have found that amounts in the range 0.15 to 0.5% are adequately effective.

It is not necessary for the anionic polyelectrolyte to have any effect on the paper beyond modifying the streaming potential of the stock. However, we have found that the inclusion of the anionic polyelectrolyte can have adventitious beneficial effects on the properties of the paper.

The presence of other charged or potentially charged species which have an effect on the streaming potential of the stock is not precluded in this invention. Such species will typically have the effect of giving a shift in the baseline streaming potential of the stock and will thus alter the amount of the anionic polyelectrolyte which is needed to give a streaming potential within the predetermined range. If these species have other effects e.g. altering the conductivity, then this can affect the magnitude and range of desired streaming potentials.

Using process water having a conductivity of 585 microSiemens (uS), we have found that, at ambient temperature (ca 15° C.), the streaming potential range appropriate to optimum sizing is typically $-1$ to $-2$ and usually about $-1.8$ millivolts per Bar pressure drop (equivalent SI units are $V.Pa^{-1}\times10^5$).

The papermaking process, apart from the adjustment of the stock to achieve a desired streaming potential, is a conventional alkaline process on a Fourdrinier machine. As well as the alkyl ketene dimer internal size, we use a starch external size at the size press and, to reduce static build-up in photographic papers, we include an inorganic salt e.g. NaCl or $Na_2SO_4$, in the press size to increase the conductivity of the paper. The process water noted above has a sufficiently high natural conductivity that incorporation of dry broke at 10% of fibre into the stock does not significantly alter the conductivity of the water. However, papermakers using very soft process water may need to compensate for conductivity changes from this source.

It is possible, though not especially preferred, to include a reactive sizing agent in the press size. In particular a supplementary amount of alkyl ketene dimer and part or all of the epoxidized fatty acid amide, or other, supplementary size, if used, can be included in the press size. The amounts used will not usually be such that the total of the reactive size or sizes i.e. both internal and press size, exceeds 2%. Further, the amount included in the press size should not be so great as to cause significant loss of adhesion of the coating of the polymeric resin.

For most purposes the base paper from the papermaking process will be resin coated on both sides, but specialist products can be made, at least initially, with a one-sided coating. Typically, for photographic base paper the resin used is a polyolefin, usually polyethylene or polypropylene coated on both sides of the paper. One or both of the resin layers can be pigmented. For photographic print base paper the paper is usually pigmented white e.g. using titanium dioxide.

The resin coated papers made by this invention can be used for other than photographic uses. In particular they can be used in food packaging where similar problems of edge penetration can arise, especially in containers for relatively aggressive foods and drinks e.g. fruit juice.

The following Examples illustrate the invention. Unless otherwise indicated all parts and percentages are by weight. The basic stock used was made from 30% bleached hardwood sulphate pulp and 70% bleached softwood sulphite pulp, beaten at a consistency of about 3% to a Schopper-Riegler wetness of about 35° SR. The process water had the following specification:

Hardness as $CaCO_3$ 280 $mg.l^{-1}$
as Carbonate 270 $mg.l^{-1}$
Alkalinity as $CaCO_3$ 270 $mg.l^{-1}$
Free $CO_2$ $\geqq mg.l^{-1}$
Chlorine as chloride 16 $mg.l^{-1}$
pH 7.4
Electrical Conductivity 585 uS at 25° C.

The size used was Aquapel 360 ex Hercules Ltd. a stabilized emulsion of alkyl ketene dimer at 7.7% total solids. The wet strength resin used was Kymene 557 H ex Hercules Ltd. a 12.5% solids aqueous solution of an epichlorohydrin modified aminopolyamide resin. The amounts of these and other additives included in the stock specified in the Examples, are quoted in weight percent dry basis on dry fibre in the stock. The various additives were included in the stock during multi-stage dilution to a consistency of 0.8%. The streaming potential of the stock was measured using a measuring instrument as described in European Patent Specification No. 0079726. The streaming potentials were measured in $mV.Bar^{-1}$ but recorded here in the equivalent units $V.Pa^{-1}\times10^5$ i.e. one "streaming potential unit"$=10^{-5}$ $V.Pa^{-1}$. Paper was made from the stock on a conventional Fourdrinier machine to give paper of 170 $g.m^{-2}$ nominal substance. At the size press the paper was externally sized with starch and a solution of a conductivity salt e.g. NaCl, and corona treated and coated on both sides with polyethylene by extrusion coating. The coating on the wire side was 32 $gm^{-2}$ of a blend of low and high density polyethylene and on the face side was 36 $gm^{-2}$ of low density polyethylene containing 10% titanium dioxide pigment. The coated paper was slit in the machine direction and reeled for subsequent testing. Edge penetration and staining were assessed using a static test and a dynamic test.

STATIC TEST

Samples cut from the reels of coated paper were immersed in Ektaprint 2 developer (a commercial developer ex Kodak Ltd.) for 20 minutes at 38° C., rinsed for 30 seconds in tap water, immersed in Ektaprint 2 bleach/fix (a commercial bleaching/fixing solution ex Kodak Ltd.) for 45 minutes at 33° C., rinsed for 30 seconds in tap water and then dried in an oven for 10 minutes at 100° C. Edge penetration and staining were assessed as described below.

DYNAMIC TEST

Reels of samples were processed through a Kreonite commercial process developer for 5 passes. For each pass the processor conditions were as follows:

Developer: Ektaprint 2; 38° C. for 3.5 minutes
Bleach/Fix: Ektaprint 2; 33° C. for 1.5 minutes
Warm Wash: 33° C. for 1.5 minutes
Cold Wash: tap water (ca 10° C.) for 1.5 minutes Edge penetration and staining were assessed as described below.

Edge Penetration is assessed as the average penetration along the edge of a sample, measured as the distance between the cut edge of the sample and the maximum inward extent of discernible discolouration of the base paper observed under a magnifier using a graticule.

Staining is assessed by visual comparison of test samples against control samples as being worse than (−), equal to (=) or better than (+) the control.

The Kenley rigidity and internal bond strength of the resin coated papers were measured as follows:

KENLEY RIGIDITY

A strip of paper 1.5 inches (3.81 cm.) wide is clamped so that 2.25 inches (5.72 cm) of the strip protrudes vertically upwards from a horizontal clamp. A probe carrying a force sensor is positioned to move in a line 5 cm above the clamping plane, perpendicular to the mid line along the test strip. The probe is moved to deflect the test strip to a position such that the angle between the line connecting the probe tip and the clamp is 15° from the vertical, within a period from 2.5 to 30 seconds. The rigidity is the measured force at this position. The Kenley test instrument gives the result in grams force but are expressed herein as milliNewtons (mN).

INTERNAL BOND STRENGTH

A test strip 1 inch (2.54 cm) wide and at least 6 inches (30 cm) long is cut. The resin coating is peeled back to enable the two ends of the delaminated section to be clamped in the jaws of a Karl-Frank motorised tensile tester. The jaws start 1 inch (2.54 cm) apart and are moved apart at 300 mm per minute. The internal bond strength is the force necessary to pull the jaws apart. The instrument gives readings in Newtons per inch which are expressed herein as $N.m^{-1}$.

EXAMPLE 1

0.7% Aquapel as internal size and 1.5% of Kymene as wet strength resin were used. The Kymene level was chosen to give adequate wet strength but no attempt was made to optimise internal sizing. The streaming potential was recorded periodically.

EXAMPLE 2 (CONTROL)

It was determined, under the conditions used that optimum Aquapel sizing was obtained at a streaming potential of between −1 and −2 and optimally about −1.8 units. 0.7% Aquapel was used as internal size and the amount of Kymene adjusted to give a streaming potential between −1 and −2 units. This level of Kymene addition was maintained and the streaming potential monitored.

EXAMPLE 3

0.7% Aquapel was used as internal size. The Kymene level (1.9%) was chosen to give good wet strength. The streaming potential was monitored and an anionic acrylamide/acrylic acid copolymer was added to alter the streaming potential to within the desired range. The amount of the copolymer used was 0.22%. The copolymer was obtained from Allied Colloids Ltd. under the designation R1144, it had a viscosity average molecular weight of about $4\times10^6$ daltons and an average acrylic acid content (by analysis) of about 42% by weight.

EXAMPLE 4

Example 3 was repeated but using a sodium salt of carboxymethyl cellulose (ex Hercules Ltd.) as the anionic polyelectrolyte instead of the acrylamide/acrylic acid copolymer used in Example 3. The amount of carboxymethyl cellulose used was 0.25%.

EXAMPLE 5

0.8% Aquapel was used as internal size, together with 0.4% of Neomodulon which is an epoxidized fatty acid amide believed to be made from stearic acid, diethylene triamine and epichlorohydrin, made by Kindai Kagaku KK, as a supplementary internal size. The Kymene level (1.6%) was chosen to give good wet strength and R1144 copolymer used to alter the streaming potential to within the desired range. The amount of R1144 used was 0.25%.

EXAMPLE 6

Example 5 was repeated but using a Kymene level of 1.7% and substituting 0.4% of C55, an epoxidized fatty acid amide from Hercules Ltd. for the Neomodulen used in Example 5. The amount of R1144 used was 0.3%.

EXAMPLE 7

Example 6 was repeated using 0.33% of C55 but substituting Versicol E11, an acrylic acid homo/-copolymer having an average molecular weight of about $2.3\times10^4$ daltons for the R1144 used in Example 6. The amount of Versicol E11 used was 0.25%. In this Example the streaming potential stabilised at a slightly higher voltage than in the previous Examples.

The test results for Examples 1 to 7 are set out in Table 1 below.

TABLE 1

| Example No. | 1 | 2 | 3 | 4 | 5 | 6 | 7 |
|---|---|---|---|---|---|---|---|
| Additives (% by wt.) | | | | | | | |
| Alkyl Ketene Dimer | 0.7 | 0.7 | 0.7 | 0.7 | 0.8 | 0.8 | 0.7 |
| Wet Strength Resin | 1.5 | 0.85 | 1.9 | 1.9 | 1.6 | 0.8 | 0.7 |
| Epoxy Fatty Acid Amide | — | — | — | — | 0.4 | 0.4 | 0.33 |

TABLE 1-continued

| Example No. | 1 | 2 | 3 | 4 | 5 | 6 | 7 |
|---|---|---|---|---|---|---|---|
| Anionic Polyelectrolyte | — | — | 0.22 | 0.25 | 0.25 | 0.3 | 0.25 |
| Streaming Potential ($V \cdot Pa^{-1}$) | | | | | | | |
| Average | +0.3 | −1.7 | −1.8 | −1.9 | −1.4 | −0.8 | −1.5 |
| High | +0.6 | −1.1 | −0.9 | −1.3 | −0.4 | −0.5 | — |
| Low | +0.1 | 2.2 | −2.0 | −2.5 | −1.7 | −1.1 | — |
| Kenley Rigidity (mN) | | | | | | | |
| Machine Direction | 33 | 31 | 33 | 33 | 26 | 26 | 31 |
| Cross Direction | 18 | 19 | 17 | 19 | 14 | 15 | — |
| Internal Bond Strength ($N \cdot m^{-1}$) | 57 | 53 | 72 | 70 | — | 51 | 50 |
| Edge Penetration (mm) | | | | | | | |
| Static | 0.9 | 0.8 | 0.6 | 0.7 | 0.5 | 0.5 | — |
| Dynamic | 1.1 | 1.0 | 0.6 | 0.8 | 0.5 | 0.5 | 0.55 |
| Staining | Control | = | + | + | + | + | + |

EXAMPLE 8

A series of trials was run to investigate the effect of changes in the sizing system and the control of streaming potential. In each trial run the paper was made as generally described above using Aquapel 360 alkyl ketene dimer at a level of 0.7% and Kymene 557H wet strength resin at a level of 1.6% based on the weight of dry fibre. The EFA supplementary sizes used were "A" Hercules C55 (referred to in previous Examples) and "B" Baysynthol 36029 supplied by Bayer AG. When used, R1144 was used as the anionic polyelectrolyte. The paper was laminated on both sides with polyethylene in a laboratory laminator and the edge penetration testing was carried out on the uncoated paper after ageing for about 24 hrs using the "dynamic" edge penetration test described above.

Table 2 below sets out the amount and type of epoxy fatty acid amide supplementary size used, the average streaming potential, the approximate amount of anionic polyelectrolyte, and the measured value of edge penetration. Procedurally the amount of anionic polyelectrolyte used was that necessary to adjust the streaming potential of the stock to the desired value.

From past experience we know that the measurement of edge penetration on laboratory laminated paper tends to give results which are somewhat optimistic, typically by about 0.1 mm. This difference is usually consistent between samples produced and processed similarly. The results set out in Table 2 indicate that the inclusion of EFA supplementary sizes without using an anionic polyelectrolyte to control the streaming potential gives no great advantage. However, the use of an EFA supplementary size and control of the streaming potential using an anionic polyelectrolyte produces very good results.

TABLE 2

| | EFA | | Anionic | | Edge |
|---|---|---|---|---|---|
| Run | Type | Amount % | Polyelectrolyte % | SPM Reading | Penetration mm |
| a | — | 0 | 0 | +3.5 | 0.5 |
| b | A | 0.5 | 0 | +4.0 | 0.6 |
| c | B | 0.5 | 0 | +4.0 | 0.5 |
| d | A | 0.5 | 0.25 | −1.5 | 0.4 |
| e | B | 0.5 | 0.25 | −1.5 | 0.4 |

We claim:

1. A method of making a resin coated paper which comprises making a base paper by an alkaline paper making method from a cellulosic fibrous stock containing from 0.2 to 2% by weight on the fibre content of the stock of an alkyl ketene dimer size, from 0.3 to 4% by weight on the fibre content of the stock of a cationic wet strength resin and an amount, within the range 0.02 to 5% by weight on the fibre content of the stock, of an anionic polyelectrolyte which is adsorbable on the cellulosic fibres, which is such as to maintain the streaming potential of the stock equivalent to a streaming potential in the range of from −1 to −2.5 millivolts per bar (measured at 15° C.) on a stock having a conductivity of about 585 microsiemens (measured at 25° C.), forming a paper from the stock and providing a coating of a polyolefin resin on at least one side of the paper.

2. A method as claimed in claim 1 wherein from 0.1 to 2% by weight on the fibre content of the stock of an epoxidized fatty acid amide size is included in the stock.

3. A method as claimed in claim 1 wherein the amount of epoxidized fatty acid amide size is from 0.2 to 0.8%.

4. A method as claimed in claim 2 wherein the weight ratio of alkyl ketene dimer size to epoxidized fatty acid amide size is from 3:1 to 1:1.

5. A method as claimed in claim 2 wherein the total amount of alkyl ketene dimer size and epoxidized fatty acid amide size is not more than 1.5% by weight on the fibre content of the stock.

6. A method as claimed in claim 1 wherein the amount of alkyl ketene dimer is from 0.4 to 1.2% by weight on the fibre content of the stock.

7. A method as claimed in claim 1 wherein the amount of cationic wet strength resin is from 0.5 to 2.5% by weight on the fibre content of the stock.

8. A method as claimed in claim 1 wherein the amount of adsorbable anionic polyelectrolyte is from 0.15 to 0.5% by weight on the fibre.

9. A method as claimed in claim 3 wherein the weight ratio of alkyl ketene dimer size to epoxidized fatty acid amide size is from 3:1 to 1:1.

10. A method as claimed in claim 4 wherein the total amount of alkyl ketene dimer size and epoxidized fatty acid amide size is not more than 1.5% by weight on the fibre content of the stock.

11. A method as claimed in claim 5 wherein the amount of alkyl ketene dimer is from 0.4 to 1.2% by weight on the fibre content of the stock.

12. A method as claimed in claim 6 wherein the amount of cationic wet strength resin is from 0.5 to 2.5% by weight on the fibre content of the stock.

13. A method as claimed in claim 7 wherein the amount of adsorbable anionic polyelectrolyte is from 0.15 to 0.5% by weight on the fibre.

* * * * *